US007232972B1

(12) United States Patent
Yang

(10) Patent No.: US 7,232,972 B1
(45) Date of Patent: Jun. 19, 2007

(54) LINE SWITCH ABLE TO MODULATE LIGHT

(75) Inventor: Wen-Ho Yang, Taipei County (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 0 days.

(21) Appl. No.: 11/430,911

(22) Filed: May 10, 2006

(51) Int. Cl.
*H01H 19/20* (2006.01)

(52) U.S. Cl. ..... 200/571; 200/570

(58) Field of Classification Search ..... 200/564–570, 200/571, 523, 526, 11 R, 11 G, 51.03–51.06
See application file for complete search history.

(56) References Cited

U.S. PATENT DOCUMENTS 4,816,623 A * 3/1989 Huang ..... 200/11 R
5,145,059 A * 9/1992 Park ..... 200/527
5,343,004 A * 8/1994 Chen ..... 200/11 R
5,586,645 A * 12/1996 Bartok ..... 200/527
5,743,387 A * 4/1998 Hung ..... 200/571
5,811,745 A * 9/1998 Hung ..... 200/11 R
6,743,995 B2 * 6/2004 Groves et al. ..... 200/527

* cited by examiner

*Primary Examiner*—Elvin Enad
*Assistant Examiner*—M. Fishman
(74) *Attorney, Agent, or Firm*—Bacon & Thomas, PLLC

(57) ABSTRACT

A line switch able to modulate light includes an upper cover, a lower cover and a rotary selector positioned between the upper and the lower cover. When the rotary selector is turned clockwise, the line switch can turn on and modulate light to be half bright, and when the rotary selector is further continuously turned clockwise, light can be modulated to be fully bright, but when the rotary selector is further turned clockwise again to return to the original position, the line switch will be under an OFF condition again. Thus the line switch has two stages of different lighting in addition to the function of turning on and off.

2 Claims, 5 Drawing Sheets

LINE SWITCH ABLE TO MODULATE LIGHT

BACKGROUND OF THE INVENTION

1. Field of the Invention

This invention relates to a line switch, particularly to one not only able to turn on or turn off light, but also able to modulate the brightness of light in two stages, small in size and simple in structure.

2. Description of the Prior Art

A conventional line switch, as shown in FIG. 1, includes an upper cover 10 and a lower cover 20. The lower cover 20 has its inner central portion provided with a projecting base 21 bored with an insert hole 211 in the center and its opposite inner sides respectively formed with an insert groove 22. In assembling, a bolt 27 is first inserted from under to pass through the insert hole 211 of the projecting base 21 of the lower cover 20. Next, a rotary copper plate 23 having the opposite ends respectively formed with a bent-up contact side, a rotary selector 24 and a nut 25 are orderly fitted on both the projecting base 21 and the bolt 27. Subsequently, two conducting terminals 26 are respectively inserted in the insert groove 22 of the lower cover 20, respectively formed with a conducting flexible strip 261 for elastically pressing the rotary copper plate 23. The two conducting terminals 26 further have their upper side provided with a pointed piercing member 262 to be pierce into a power conducting wire to enable electric current to be transmitted to the conducting terminals 26 through the piercing members 261. Finally, the upper cover 10 is firmly covered on the lower cover 20 by having its inner threaded base screwed tightly with the bolt 27.

In using, when the rotary selector 24 is turned clockwise to let the two contact sides 231 of the rotary copper plate 23 respectively contact with the flexible strips 261 of the two conducting terminals 26, the electric current of the conducting terminals 26 will be transmitted to the rotary copper plate 23 to make electrical connection. When the rotary selector 24 is continuously turned in the same direction until the two contact sides 231 of the rotary copper plate 23 are disconnected from the flexible strips 261 of the conducting terminals 26, electric current is unable to get through to the rotary copper plate 23, thus turning off circuit. Although simple in structure, the conventional line switch can only turn ON and OFF of light but cannot modulate the brightness of light, inconvenient in use.

SUMMARY OF THE INVENTION

The objective of the invention is to offer a line switch not only able to turn on or turn off light, but also able to modulate the brightness of light, small in size and simple in structure.

The line switch able to modulate light in the present invention includes an upper cover, a lower cover and a rotary selector. The upper cover has its opposite inner sides respectively receiving a conducting terminal formed with a pointed piercing member extending toward the lower cover to pierce into a power conducting wire provided inside the lower cover. The rotary selector is provided with a ratchet formed with six contact portions and bored with an accommodating groove for receiving a diode that has function of half-wave rectification. The diode has its opposite sides respectively welded thereon with a metal plate extending downward to be closely attached on a second pair of two symmetrical contact portions of the ratchet. A straight-through conducting member is assembled crossing over the diode and positioned on a third pair of two symmetrical contact portions of the ratchet. The rotary selector is positioned between the upper and the lower cover, and has the ratchet formed with six contact portions that constitute three pairs of two symmetrical contact portions facing the upper cover. Thus, when the conducting terminals of the upper cover respectively contact with a first pair of two symmetrical contact portions of the ratchet that are provided with no conducting members, the line switch is under an OFF condition. When the rotary selector is turned clockwise to let the two conducting terminals respectively contact with the two metal plates of the diode that has function of half-wave rectification, light can be turned on and modulated to be half bright, and when the rotary selector is further continuously turned in the same direction until the conducting terminals contact with the straight-through conducting member, light can be modulated to be fully bright.

In addition, a hard insulating board is assembled between the upper and the lower cover, and the piercing members of the conducting terminals are respectively inserted through the insert notches of the insulating board and then pierce into the power conducting wires positioned inside the lower cover.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
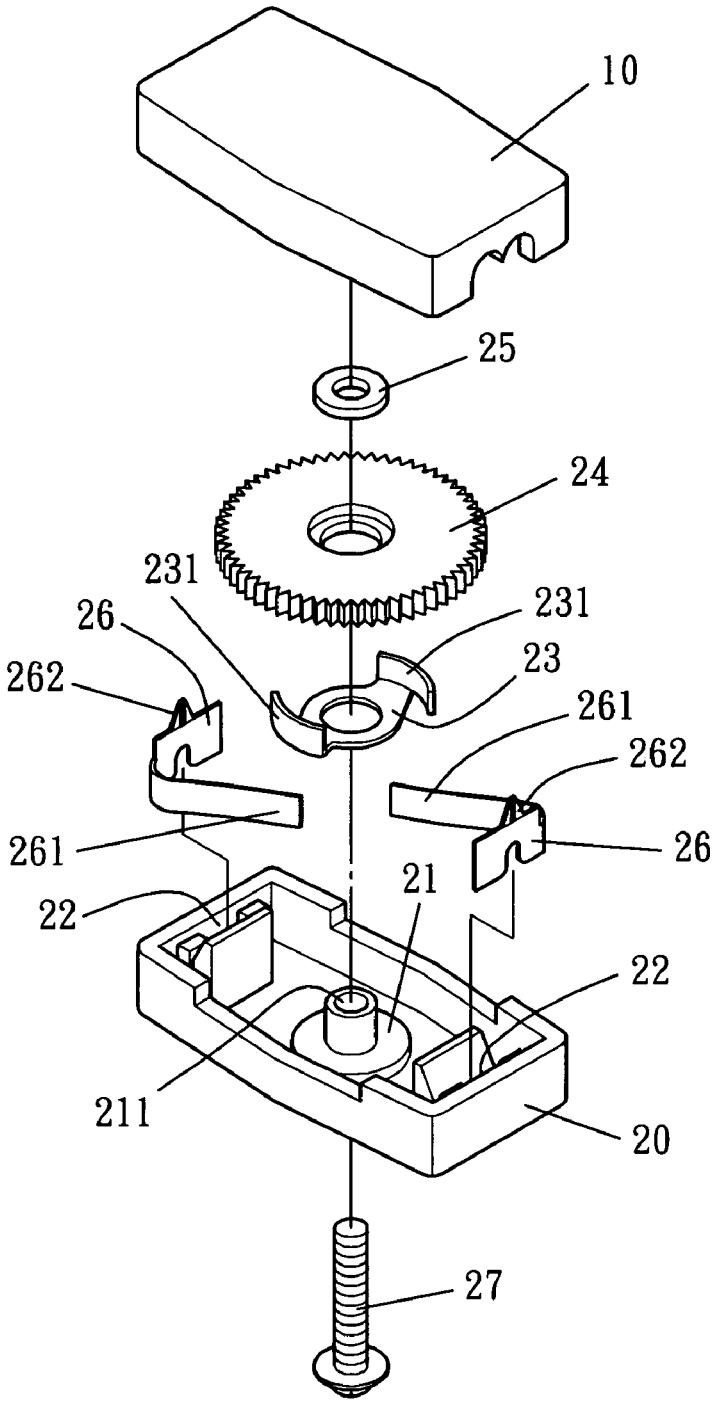
FIG. 1 (PRIOR ART)
FIG. 1 is an exploded perspective view of a conventional line switch.
Figure 2:
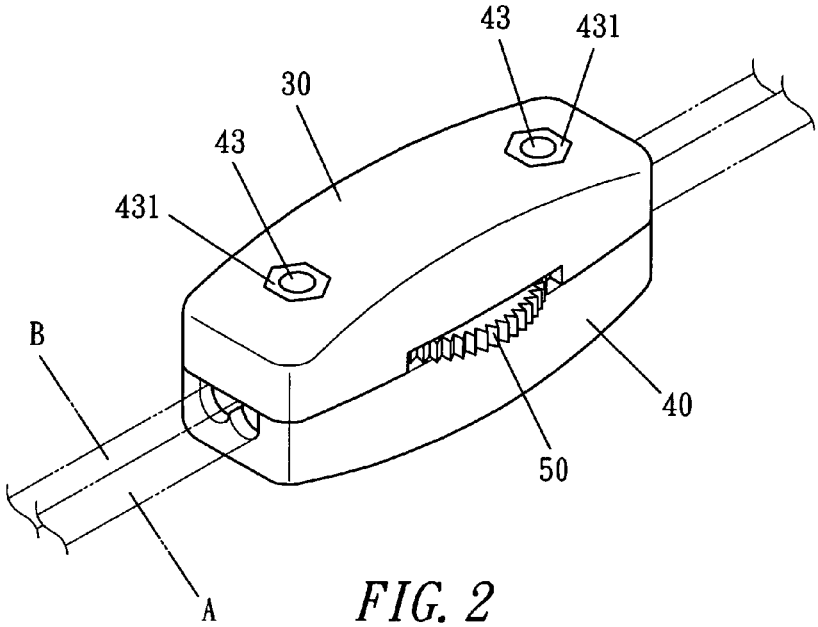
FIG. 2 is a perspective view of a line switch able to modulate light in the present invention.
Figure 3:
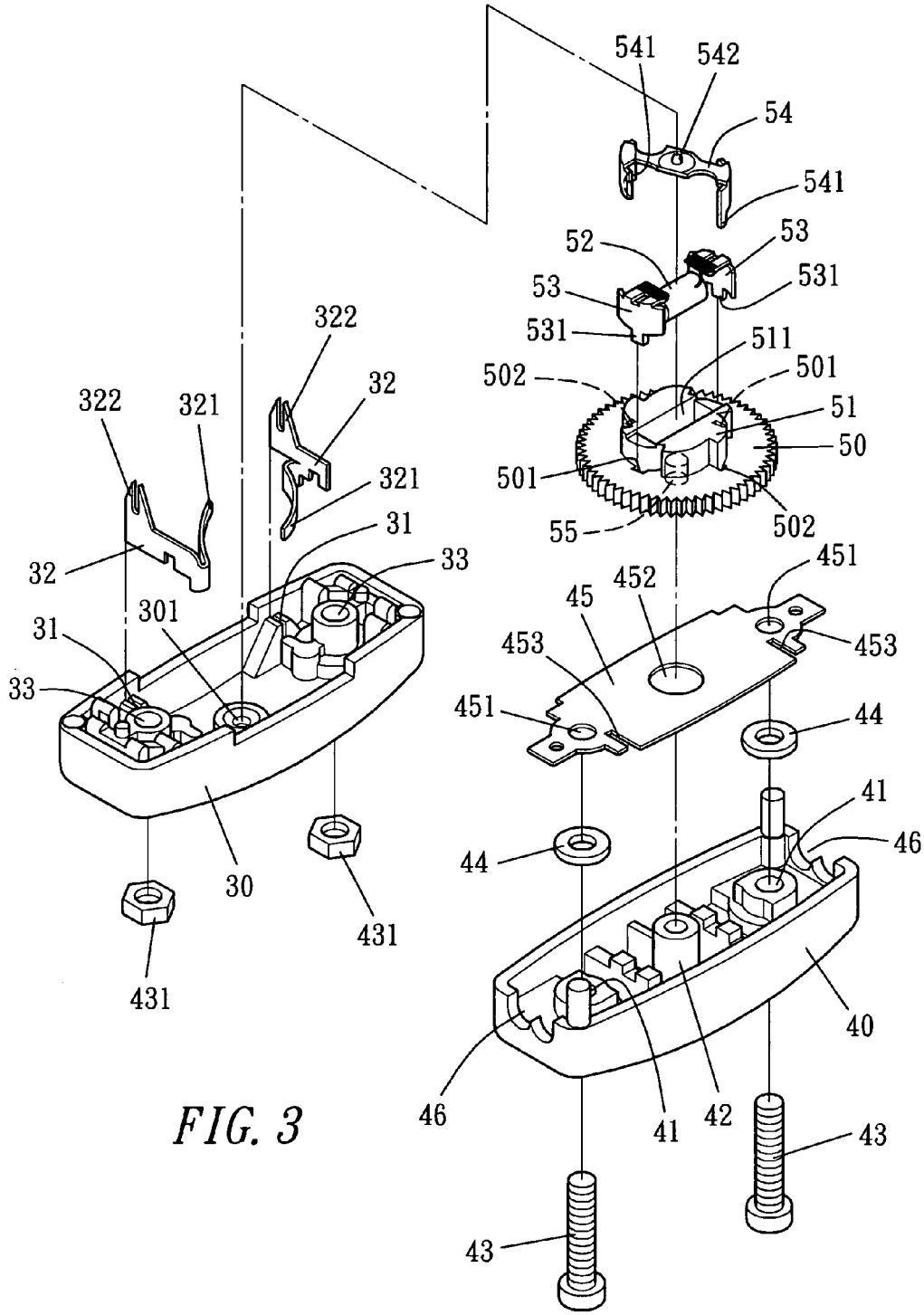
FIG. 3 is an exploded perspective view of the line switch able to modulate light in the present invention.

A preferred embodiment of a line switch able to modulate light in the present invention, as shown in FIGS. 2 and 3, includes an upper cover 30, a lower cover 40 and a rotary selector 50 as main components combined together.

The upper cover 30 has its opposite inner sides respectively formed with an insert notch 31 for receiving a conducting terminal 32, which is respectively formed with a conducting flexible strip 321 and has its upper side formed with a pointed piercing member 322 extending upward to be pierced into a power conducting wire to enable electric current to be transmitted to the conducting terminals 32 through the piercing members 322. Further, the upper cover 30 has its opposite inner sides respectively bored with an insert hole 33 and its intermediate portion formed with a low accommodating hole 301.

The lower cover 40 has its opposite inner sides respectively bored with an insert hole 41 corresponding to the insert hole 33 of the upper cover 30 and its inner central portion provided with a projecting tubular post 42 matching with the low accommodating hole 301 of the upper cover 30. Two bolts 43 are respectively inserted through the insert holes 41 and fitted thereon with a washer 44 and then a hard insulating board 45 is positioned on the lower cover 40. The hard insulating board 45 is bored with two insert holes 451 and a central through hole 452 respectively corresponding to the insert slots 41 and the projecting tubular post 42 of the lower cover 40 and also has its opposite sides respectively cut with an elongate insert slot 453. Furthermore, the lower cover 40 has its opposite walls respectively cut with two curved recesses 46 in the upper side for power conducting wires to be inserted therethrough.

Figure 4:
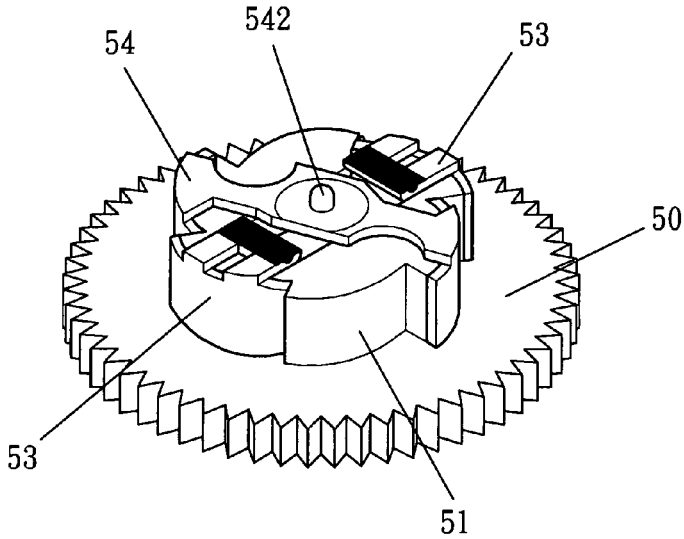
FIG. 4 is a perspective view of a rotary selector in the present invention.

The rotary selector 50, as shown in FIG. 4, is provided with a ratchet 51 formed with six contact portions that constitute three pairs of two symmetrical contact portions. The ratchet 51 is bored with an accommodating groove 511 in the center for receiving a diode 52, which has its opposite sides respectively welded thereon with a metal plate 53 to be positioned on a second pair of two symmetrical contact portions of the ratchet 51. The two metal plates 53 of the diode 52 respectively have the lower side extending downward to form an insert foot 531 to be inserted in the opposite insert notches 501 of the rotary selector 50 and positioned therein. A straight-through conducting member 54 is positioned crossing over the diode 52 and has the opposite sides respectively positioned on a third pair of two symmetrical contact portions of the ratchet 51. The straight-through conducting member 54 further has its opposite ends respectively extending downward and forming an insert foot 541 to be inserted in the insert slot 502 of the rotary selector 50. The straight-through conducting member 54 is positioned across the diode 52 but dose not contact with the diode 52; therefore, the diode 52 and the straight-through conducting member 54 can be electrically connected respectively without interfering with each other. The straight-through conducting member 54 has its upper central portion fixed with a positioning projection 542 to be positioned and supported in the accommodating hole 301 of the upper cover 30. In addition, the rotary selector 50 is disposed with a positioning projection 55 in the center of the other side to be inserted through the through hole 452 of the insulating board 45 and then positioned on the projecting tubular post 42 of the lower cover 40.

In assembling, firstly, the rotary selector 50 is positioned between the upper and the lower cover 30, 40 with its ratchet 51 facing the upper cover 30 to enable the conducting flexible strips 321 of the conducting terminals 32 to elastically press the rotating contact portions of the ratchet 51. Subsequently, then the two bolts 43 are respectively inserted through the insert slots 33 of the upper cover 30 and screwed with two nuts 431 to tightly combine the upper and the lower cover 30, 40 together. Thus, the rotary selector 50 can be turned from the outer side of the upper and the lower cover 30, 40.

Figure 8:
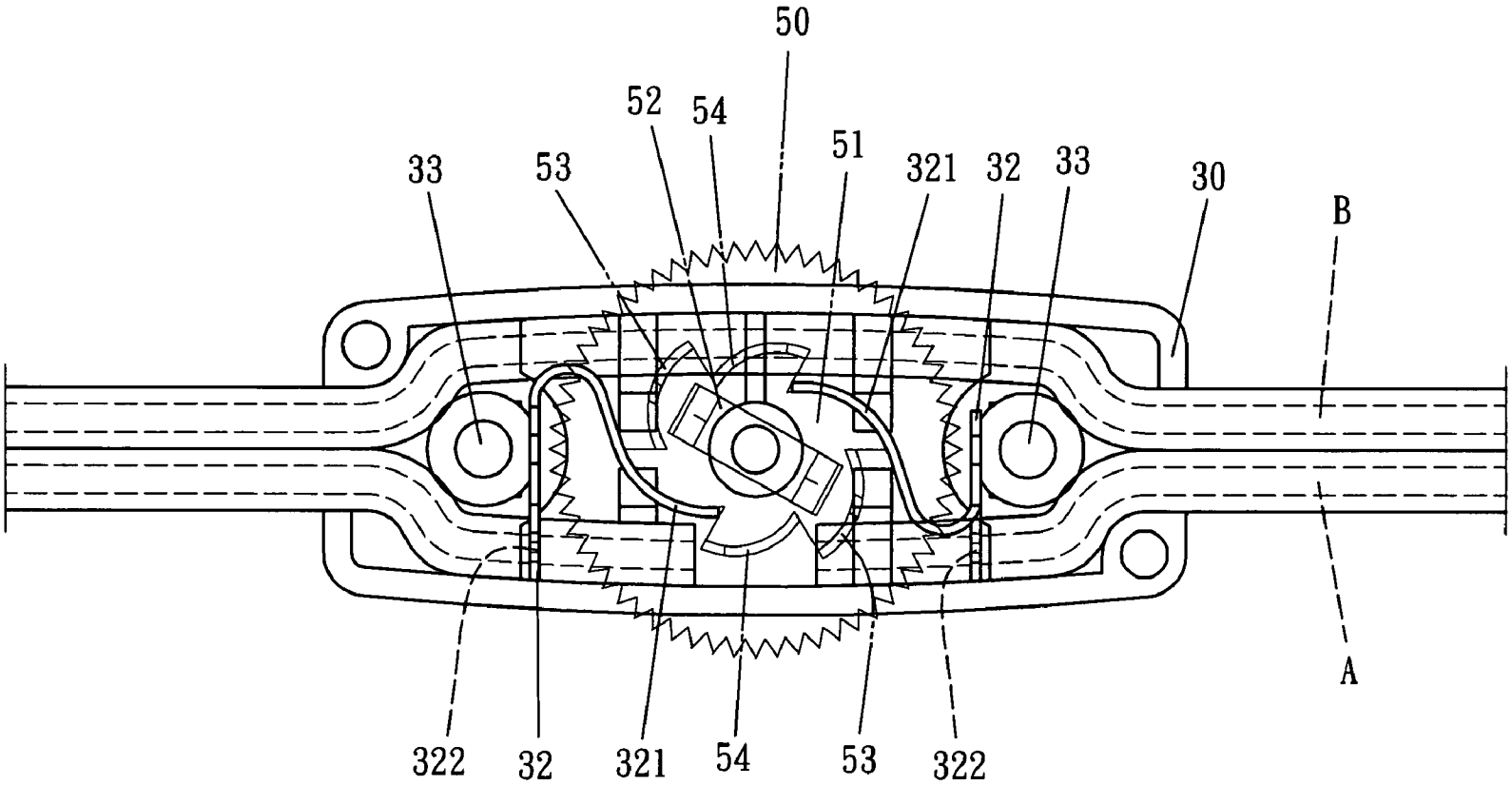
FIG. 8 is an upper cross-sectional view of the line switch connected with power conducting wires in the present invention.

In using, power conducting wires have to be installed first and then the line switch of this invention is connected between the power source and a lamp socket. To install the power conducting wires, as shown in FIG. 8, the conducting wire (A) and (B) are respectively received in the receiving recesses 46 at the opposite sides of the lower cover 40, and the conducting line (B) in the interior of the lower cover 40 is not cut off, but the conducting wire (A) in the interior of the lower cover 40 is cut off. Then, the upper and the lower cover 30, 40 are combined together to let the piercing members 322 of the two conducting terminals 32 respectively pierce into the two ends of the conducting wire (A) positioned inside the lower cover 40. Thus, the electric current of the conducting wire (A) can be transmitted to the two conducting terminals 32 through the two piercing members 322 to be conducted with the metal plates 53 on the ratchet 51 of the rotary selector 50 or with the straight conducting member 54.

Figure 5:
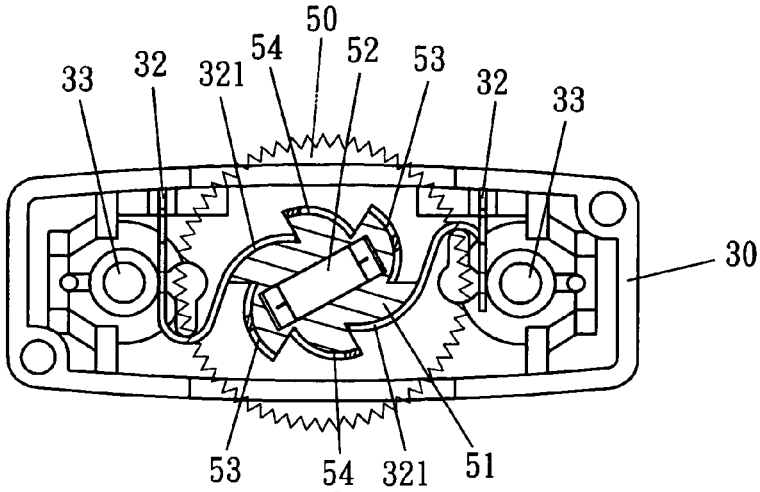
FIG. 5 is an upper cross-sectional view of the line switch in an OFF condition in the present invention.
Figure 6:
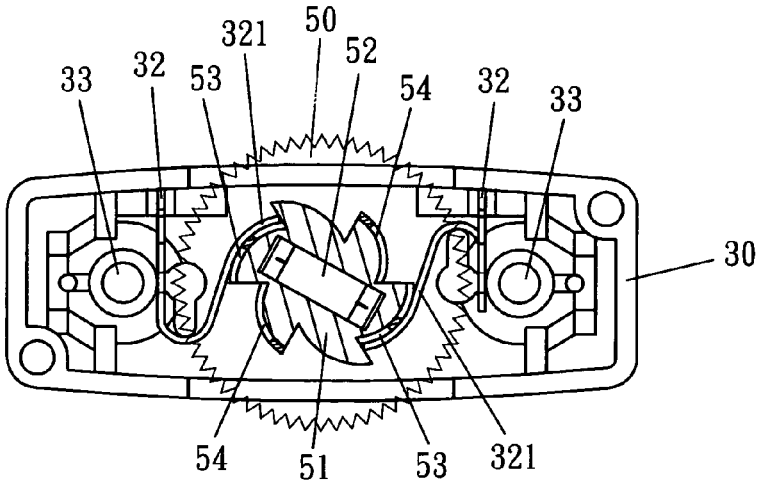
FIG. 6 is an upper cross-sectional view of the line switch having the metal plates of a flexible member respectively contacting with the spring strips of two conducting terminals to modulate light to be half bright in the present invention.
Figure 7:
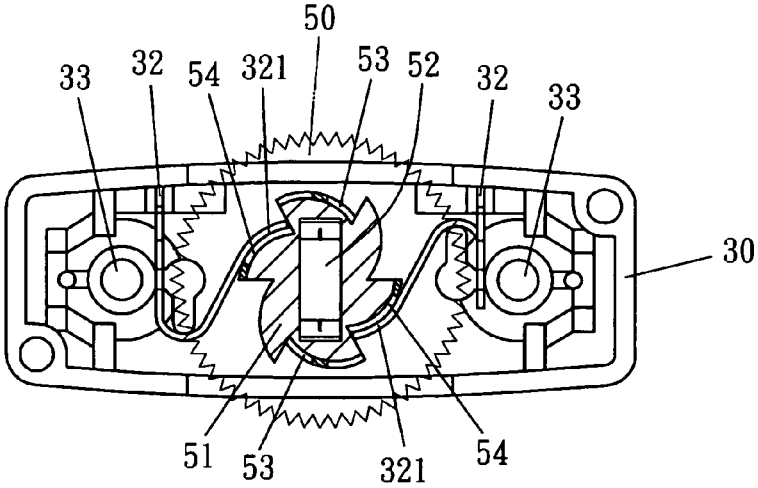
FIG. 7 is an upper cross-sectional view of the line switch having a straight-through conducting member contacting with the conducting flexible strips to modulate light to be fully bright in the present invention.

When the metal plates 53 on the ratchet 51 of the rotary selector 50 and the straight-through conducting member 54 do not contact with the conducting flexible strips 321 of the conducting terminals 32, that is to say, when the conducting flexible strips 321 of the conducting terminals 32 respectively contact with first pair of two symmetrical contact portions of the ratchet 51 that have no conducting member provided thereon, the two conducting terminals 32 are not electrically connected with each other and the line switch is under an OFF condition, as shown in FIG. 5. When the rotary selector 50 is turned clockwise from the off-position to let the two metal plates 53 fixed on a second pair of two symmetrical contact portions of the ratchet 51 respectively contact with the two conducting flexible strips 321 of the two conducting terminals 32, the current of the conducting wire will pass through the diode 52 via the conducting flexible strips 321 of the conducting terminals 32. So by the means of half-wave rectification of the diode 52, the line switch will modulate light to be half bright as a first stage of lighting, as shown in FIG. 6. When the rotary selector 50 is further continuously turned clockwise until the straight-through conducting member 54 fixed on a third pair of two symmetrical contact portions of the ratchet 51 contact with the two conducting flexible strips 321 of two conducting terminals 32, light will be modulated to be fully bright as a second stage of lighting, as shown in FIG. 7. If the rotary selector 50 is further turned clockwise again to return to the original position, the line switch will recover to an OFF condition, as shown in FIG. 5. Thus, by continuously turning around the rotary selector 50, the line switch of this invention can carry out two-stage light modulation in addition to function of turning on and off.

Evidently, aside from having function of turning on and turning off light, the line switch of this invention can also modulate light in two stages, i.e. fully bright and half bright.

While the preferred embodiment of the invention has been described above, it will be recognized and understood that various modifications may be made therein and the appended claims are intended to cover all such modifications that may fall within the spirit and scope of the invention.

I claim:

1. A line switch able to modulate light comprising an upper cover, a lower cover and a rotary selector:

said upper cover having its opposite inner sides respectively receiving a conducting terminal, each said conducting terminal formed with a pointed piercing member extending downward to pierce into a power conducting wire positioned in said lower cover; and, said rotary selector provided with a ratchet formed with six contact portions that constitute three pairs of two symmetrical contact portions, said ratchet bored with an accommodating groove for receiving a diode that has function of half-wave rectification and its opposite sides respectively welded thereon with a metal plate extending downward, said two metal plates of said diode respectively positioned on a first pair of said two symmetrical contact portions of said ratchet, a straight-through conducting member positioned crossing over said diode and assembled on a second pair of said two symmetrical contact portions of said ratchet, said rotary selector positioned between said upper cover and said lower cover, said ratchet of said rotary selector having its contact portions facing said upper cover;

said line switch being under an OFF condition when said conducting terminals contact with a first pair of said two symmetrical contact portions of said ratchet that have no conducting member provided thereon, said line switch modulating light to be half bright when said rotary selector is turned clockwise to let said conducting terminals contact with said two metal plates of said diode that has function of half-wave rectification, said line switch modulating light to be fully bright when said rotary selector is further continuously turned clockwise until said conducting terminals contact with said straight-through conducting member.

2. The line switch able to modulate light as claimed in claim 1, wherein a hard insulating board is assembled between said upper and said lower cover, and said piercing members of said conducting terminals are respectively inserted through two insert notches of said insulating board and then pierce into said power conducting wire positioned in said lower cover.

* * * * *